US005241158A

United States Patent [19]

Schreder

[11] Patent Number: 5,241,158

[45] Date of Patent: Aug. 31, 1993

[54] ELECTRIC HOTPLATE

[75] Inventor: Felix Schreder, Oberderdingen, Fed. Rep. of Germany

[73] Assignee: E.G.O. Elektro-Gerate Blanc u. Fischer, Fed. Rep. of Germany

[21] Appl. No.: 715,323

[22] Filed: Jun. 14, 1991

Related U.S. Application Data

[63] Continuation of Ser. No. 378,854, Jul. 12, 1989, abandoned.

[30] Foreign Application Priority Data

Jul. 21, 1988 [DE] Fed. Rep. of Germany ..... 3824746

[51] Int. Cl.[5] ..... H05B 3/70

[52] U.S. Cl. ..... 219/458; 219/457; 219/463

[58] Field of Search ..... 219/457, 458, 459, 460, 219/443, 462, 464, 465, 448, 449

[56] References Cited

U.S. PATENT DOCUMENTS

| | | | |
|---|---|---|---|
| 1,892,298 | 12/1932 | Bray | 219/458 |
| 1,943,144 | 1/1934 | Richardson | 219/458 |
| 2,664,492 | 12/1953 | Fischer | 219/457 |
| 4,829,160 | 5/1989 | Fischer | 219/467 |

FOREIGN PATENT DOCUMENTS

| | | | |
|---|---|---|---|
| 903128 | 12/1953 | Fed. Rep. of Germany . | |
| 939534 | 2/1956 | Fed. Rep. of Germany . | |
| 1130574 | 5/1962 | Fed. Rep. of Germany . | |
| 1565049 | 3/1972 | Fed. Rep. of Germany . | |
| 3230085 | 2/1984 | Fed. Rep. of Germany . | |
| 437566 | 11/1967 | Switzerland | 219/443 |
| 424297 | 2/1935 | United Kingdom | 219/458 |

*Primary Examiner*—Teresa J. Walberg
*Attorney, Agent, or Firm*—Quarles & Brady

[57] ABSTRACT

In the case of an electric hotplate (1), the profile ring (17) for supporting on the hob (2) is provided by an elastically resilient circumferential stretching and a resilient cross-sectional zone (29) with an outer ring leg (18) resiliently deflectable within close tolerances and which by a washer-like circular rim (28) forms a flat support surface (26) for support on the hob (2). The consequently cup springlike, movable seat part (25) of profile ring (17), on securing the electric hotplate (1), slides with a sliding edge (27) out of an angular position into a whole-area engagement on seat (8) of hob (2).

25 Claims, 2 Drawing Sheets

ELECTRIC HOTPLATE

This is a continuation of application Ser. No. 378,854, filed Jul. 12, 1989, abandoned.

BACKGROUND OF THE INVENTION

1. Field of the Invention

The invention relates to an electric hotplate having a profile plate body with a support ring used for support purposes on the top of a hob or the like and for this purpose is advantageously provided in the form of a profile ring with an outwardly projecting ring leg, which has a support surface for supporting purposes.

2. Prior Art

In known hobs of this type the profile ring or support leg is between approximately 4 and 8 mm high. With decreasing height, it becomes increasingly more difficult to achieve such a sealed engagement of the profile ring on the top of the hob or a sill or spillage rim shaped into it that no liquid penetrates to the hotplate body beneath the hob, if a relatively large amount of liquid flows over the profile ring or is located in the hob.

SUMMARY OF THE INVENTION

An object of the invention is to provide an electric hotplate of the aforementioned type making it possible in simple manner to prevent liquid or water passing from the top of the hob through the seat of the profile ring into the hotplate body and e.g. to electrically conductive parts.

According to the invention this object is achieved in the case of an electric hotplate of the aforementioned type in that at at least one point in one area from the profile ring to the underside of the electrically heated region of the hotplate body an elastically resilient seal with substantially pressure-tight engaging seats is provided in such a way that any penetrating water must pass through said seal, but is blocked by the latter from leaking or flowing further. Thus, even when using a relatively flat profile ring, whose height tolerances are relatively high due to its manufacture and installation, an advance of the water to the electrically conductive parts can still be avoided if the sill of the hob is made relatively flat or drops in shallow manner to the horizontal position, has its marginal edge directed upwards or radially inwards or even passes into a component passing beneath the underside of the hotplate body. The inventive construction makes it possible to install a hob constructed as a flush or built-in hob with one, two or more electric hotplates directly alongside a washbasin or sink, which can be advantageous for very small kitchens.

It is conceivable to use pressure elastic materials, such as heat resistant silicones for sealing purposes, but a particularly high fatigue strength of the seal is obtained if the seats thereof are metallic, i.e. sealing takes place in the form metal against metal. In the case of sufficiently fine working or close tolerances a pressure-tight seal can be obtained without any labyrinth-like construction of the interengaging seats. It is also conceivable to have one seat of the seal made from a glass-like material, e.g. an enamel and with which the sheet metal body of the hob can be coated.

If at least one seat part is formed by the profile ring, the latter is appropriately made from thinner sheet metal than hitherto, so that it has relatively good bending spring characteristics with respect to the inner and/or outer profile leg and the particular profile leg as a seat part elastically resiliently engages either on a mating surface of the hob or on a mating surface of the hotplate body.

It is possible to form the seat by a substantially acute-angled ring or circular edge, e.g. the edge face located on the outer circumference of the profile ring, but particularly good sealing conditions are obtained if the sealing face has a larger radial extension, particularly a radial extension which is two to five times greater than the sheet metal thickness of the profile ring.

The ring edge can also be formed by the hotplate body and can be in the form of an obtuse-angled shoulder face on the outer circumference thereof and then appropriately the profile ring engages with an inner circumferential face in substantially linear manner on said ring edge.

The invention also proposes for achieving the foregoing objects an electric hotplate in which, instead of the hitherto described construction or in addition thereto, a protective casing is provided on the outer circumference of the hotplate body in such a way that the latter shields the interior of said body against the penetration of water. This protective casing can extend over part or the entire height of the hotplate body and closely surrounds its outer flange rim or border only with a gap spacing.

Instead of the hitherto described constructions or in addition thereto, the object of the invention can also be achieved in that at least one and in particular the outer circumference of the hotplate body below the profile ring has an approximately closed, surrounding dripping edge, which is so linked with the predetermined flow path of any penetrating water, that the same necessarily reaches the dripping edge and can only pass on from the latter by dripping or detachment from the electric hotplate.

These and further features of preferred further developments of the invention can be gathered from the claims, description and drawings. The individual features can be realized singly or in the form of subcombinations in an embodiment of the invention and in other fields and constitute advantageous constructions, which are independently patentable and for which protection is here claimed.

BRIEF DESCRIPTION OF THE DRAWINGS

An embodiment of the invention is described in greater detail hereinafter relative to the drawings, wherein show.

DETAILED DESCRIPTION OF THE PREFERRED EMBODIMENTS

Figure 1:
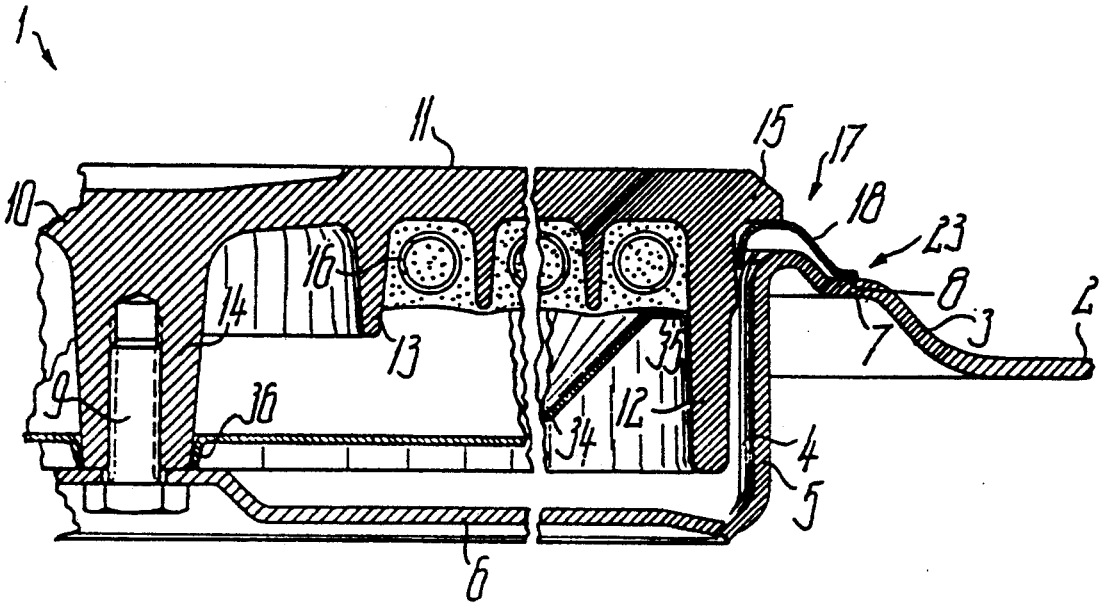
FIG. 1 is a detail of an inventive electric hotplate in cross-section.
Figure 2:
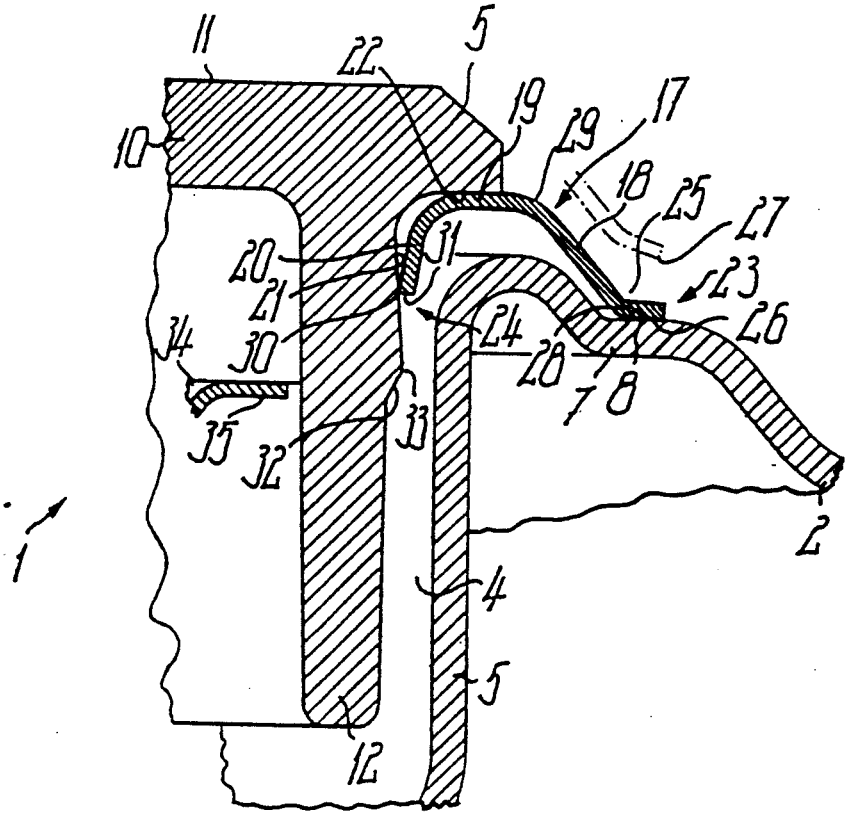
FIG. 2 is a detail of FIG. 1 on a larger scale.

The electric hotplate 1 according to FIGS. 1 and 2 is intended for fixing to a hob 2, e.g. deep-drawn from sheet steel and from which is drawn upwards for each electric hotplate 1 a sill or spillage edge 3 completely surrounding the same, in such a way that on the outer circumference of hotplate 1 it forms a type of sloping ramp and in the vicinity of its inner circumference forms an opening 4 for the partially surface-flush reception of hotplate 1. On the inner circumference, which is formed by a torus or ring bead forming its highest area with more than a segment or approximately semicircular cross-section, the sill 3 passes into a downwardly projecting, one-piece casing 5 emanating from the radially inner leg of said torus and which surrounds in contact-free manner and with a small gap clearance the surface-flush part of electric hotplate 1 and at the lower end passes into a transverse part 6, e.g. formed by an approximately closed base.

Radially outside and directly following onto the radially outer leg of the torus, the sill 3 passes into an approximately ring disk, target or washer-shaped seat part 7, which is slightly lower than the apex of the torus and which at the top thereof forms a ring shoulder-like seat 8. The latter can be approximately parallel to the plane of the hob or to the cooking surface of the electric hotplate 1 or can drop away radially outwards with respect thereto under a few radians. The radial extension of seat 8 is only slightly larger than that required for supporting the electric hotplate 1 and seat 8 passes radially outwards directly into a ramp falling away under an angle of approximately 45° and which is directly connected to the lowest lying plate plane of hob 2. Against seat 8 hotplate 1 is braced with at least one fastening screw 9, which appropriately passes through an opening in transverse part 6.

The electric hotplate 1 has a cast iron hotplate body 10, which forms at its top a substantially planar and circular cooking surface 11. Cooking surface 11, like the hotplate body 10 can be bounded on the outer circumference in a round or circular or angular, e.g. rectangular or square manner and then appropriately the sill 3 has a correspondingly adapted shape.

Hotplate body 10 forms an outer flange rim or border 12 set back slightly with respect to its outer circumference and projecting in casing-like manner over its underside, an inner flange rim or edge 13 located in radial spacing within the same and projecting less far outwards and a center stud 14 once again located in radial spacing within the same and which projects downwards roughly to the same extent as the outer flange rim 12, so that the lower end face of flange rim 12 or center stud 14 forms the bottom zone of the hotplate body 10. Over the outer circumference of the outer flange rim 12 projects a collar 15 connected to the cooking surface 11 and whose outside width is larger than the inside width of the opening 4 intended for receiving the outer flange rim 12 and whose outer circumference passes via a chamfer into the cooking surface 11.

At least one spiral groove for receiving at least one heating resistor 16 in the form of a resistance wire coil embedded in a molded insulating material in contact-free manner with respect to hotplate body in the associated spiral groove is provided between the flange rims 12,13 in the underside of the hotplate body 10. From the heating resistor or resistors 16 project downwards beyond the insulating material bare pins (not shown), which below the insulating material and above the underside of body 10 are connected to bare, inherently rigid leads located roughly parallel to cooking surface 11 and e.g. located within a closed area. These leads are bent by an insulator and led out of the underside of the electric hotplate and are intended for connecting to the operating lines of the cooker or the like.

Radially centered on the outer circumference of the outer flange rim 12 and axially supported on collar 15, a sheet metal profile ring 17 is fixed by pressing to hotplate body 10 and projects over the outer circumference of body 10 or collar 15 and by the thickness of collar 15 is located entirely below cooking surface 11. The cross-sectionally, approximately U-shaped and downwardly width trapezoidally widened profile ring 17 has a radially outer profile leg 18 projecting downwards away from the cooking surface 11 and located completely outside collar 15 and which passes downwards and outwards under an angle of approximately 45°. The profile leg 18 constructed in the manner of a cone casing passes with its upper end or upper ring zone into a washer-shaped, approximately planar profile portion 19 in the form of a U-crossweb, which in its radially inner area passes into the downwardly projecting, casing-like profile part 20 provided as the inner leg part and which projects slightly less far downwards than profile leg 18.

With profile part 20, profile ring 17 under pressure is located on a pressing surface 21 formed by the outer circumference of the outer flange rim 12, said surface being widened in acute-angled manner in cross-section under a few radians and passes upwards via a pitch circular, concave fillet into an approximately planar, ring shoulder-like bearing surface 22, which is formed by the underside of collar 15 and roughly level with the base faces of the ring grooves is used for receiving the heating resistors 16. The radius of curvature of the fillet is appropriately smaller than that of a cross-sectionally, also approximately pitch circular transition region between profile portion 19 and profile part 20 and convexly partly engaging in said fillet, so that the latter and the transition portion are completely contact-free with respect to one another. The top of the profile portion 19 engages in approximately whole-surface manner on the bearing surface 22 of hotplate body 10, which is finely finished e.g. by turning.

The support of profile ring 17 on seat part 7 of hob 2 is provided as a seal 23, so that any water on the hob 2 above the height of said support does not pass under profile ring 17 into opening 4 and therefore to the outer circumference of flange rim 12, as well as from there to the electrically conductive parts of the electric hotplate 1. Similarly appropriately the engagement of the profile part 20 in flange rim 12 is constructed as a seal 24, so that water cannot advance between the top of profile ring 17 and hotplate body 10 to the latter. The engagement of profile portion 19 on bearing surface 22 can also be in the form of a seal, so that there is a double or triple seal.

In order to obtain seal 23 the profile leg 18 forms with its lower end the seat part 25 complementary to seat part 7 and which at its underside forms a constant width, washer-like support surface 26 extending to the greatest outside width of profile ring 17 or hotplate 1 and which as a linear sealing surface in axial section engages in substantially whole-area, resiliently pretensioned manner on the seat 8, so that seat part 25 is resiliently deflectable by a small amount or with high spring progression with respect to the hotplate body 10. FIG. 2 shows seat part 25 in dot-dash line form in its relaxed state, in which the support surface 26 assumes a radially outwardly closing very small angle of one to a few radians. Thus, the circular edge forming the transition to the radially outer circular edge face of seat part 25 bounding the support surface 26 on the outer circumference is slightly lower than the remaining surface 26, so that said circular edge can form a sliding edge 27 which, on inserting hotplate 1 in hob 2, engages solely on seat 8.

If the electric hotplate 1 is now braced, e.g. with the aid of the fastening screw 9 engaging in a taphole of center stud 14 against hob 2, in much the same way as a cup spring, seat part 25 is deformed in the direction of a planar state and is slightly radially widened. During this deformation the sliding edge 27 can slide radially outwards by a small amount, e.g. less than 1 mm on seat 8 and simultaneously the angle between seat 8 and support surface 26 is closed until the latter engages in whole-surface manner on seat 8. This leads to a sudden rise in the spring characteristic of seat part 25, so that the final assembly position is reached, in which seat 8 and support surface 26 sealingly engage over the entire circumference, because the seat part 25 can compensate cup spring-like unevennesses or tolerance divergences occurring over the circumference.

As a result of the cup spring-like construction, over the circumference seat part 25 forms portions which, within the necessary, relatively small, but existing tolerance divergences, can be subject to different deflections, said tolerance divergences also e.g. possibly occurring on drawing the profile ring 17 onto the hotplate body 10.

For forming the support surface 26, which is offset or angular with respect to the inner circumference of the main part of profile leg 18 and whose radial extension is slightly smaller than that of seat 8 or corresponds to roughly 1.5 to 5 times, preferably approximately 3 times the sheet metal thickness of profile ring 17, profile leg 18 is angled in obtuse-angled manner outwards in axial section on its outer circumference to an approximately washer-like circular rim 28. Outside the outer flange rim 12, the electric hotplate 1 engages solely with its circular rim 28 on hob 2, whereas it or the profile ring 17 otherwise has a radial or axial gap spacing with respect to hob 2. The rising main portion of profile leg 18 is also contactfree with respect to the associated flank of the torus of sill 3.

In order to obtain the described resilient action, the material thickness, cross-sectional shape and material of the profile ring 17 are so matched that in its circumferential direction the profile leg 18 has a small tension or elongation elasticity for the resilient reception of the widening forces and also is slightly resiliently deflectable by the cross-sectionally pitch-circular cross-sectional zone 29 formed by portions interconnecting in obtuse-angled manner and which forms the transition between profile leg 18 and profile portion 19. This curved cross-sectional zone 29 is located substantially completely radially outside the hotplate body 10 or bearing surface 22, to which it is tangentially connected. The average radius of curvature of cross-sectional zone 29 is several times larger than the material thickness of profile ring 17, while the transition to the circular rim 28 is roughly acute-angled or such that the associated average radius of curvature is of the order of magnitude of the material thickness of profile ring 17.

In the radially inner area the profile ring 17 only engages with the hotplate body 10 or pressing surface 21 with a cross-sectionally, substantially sharp circular or ring edge 30, which is formed by the radially inner edge of the lower terminal edge face 31 of profile part 20. To this end, profile part 20 is downwardly conically tapered in acute-angled manner or is located in axial section under a small, downwardly closing angle to pressing surface 21 and the oppositely closing cone angle of profile part 20 and pressing surface 21 can be approximately the same. The lower terminal edge face 31 is appropriately higher by one or several times the material thickness of profile ring 17 than the support surface 26. Profile ring 17 is contact-free with respect to the hotplate body 10 between ring edge 30 and bearing surface 22.

At a distance below profile part 20 or ring edge 30, the outer circumference of the outer flange rim 12 forms an offset, upwardly acute-angled conically widened ring shoulder 32 which, in the same way as the lower terminal edge face 31 of the profile ring 17, is located below the apex of sill 3 and is also deeper than support surface 26. This ring or circular shoulder 32 forms with the downwardly widened pressing surface 21 which is obtuse-angled in axial section thereto, a cross-sectionally obtuse-angled ring edge 33, which defines the maximum outer circumference of the outer flange rim 12.

The underside of the hotplate body 10 can be closed by a closing cover 34 belonging to the preassembled electric hotplate 1 and which, appropriately at least in its radially outer region extending approximately to the outer flange rim 12 is located substantially completely above the underside of hotplate body 10 or the lower end face of flange rim 12 and is e.g. supported within the flange rim 12, with a washer-like support rim 35 on the underside of the insulating material for the heating resistor 16 immediately adjacent to the inner circumference of rim 12. In the center cover 34 has an axial securing or fixing member 36 e.g. engaging in the outer circumference of center stud 14 so that captive fixing with respect to body 10 is ensured. Another lower, cover-like closure for the hotplate body 10 is also formed by the cup-shaped casing 5 constructed with transverse part 6, which can substantially tightly engage centrally on the lower end face of center stud 14.

Figure 3:
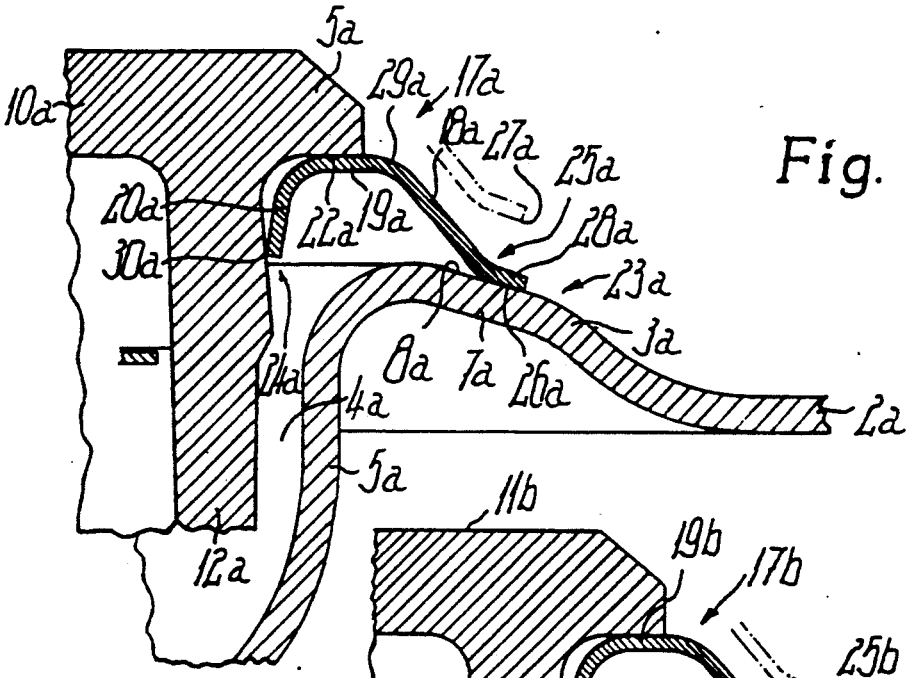
FIGS. 3 to 5 are three further embodiments in representations corresponding to FIG. 2.
Figure 4:
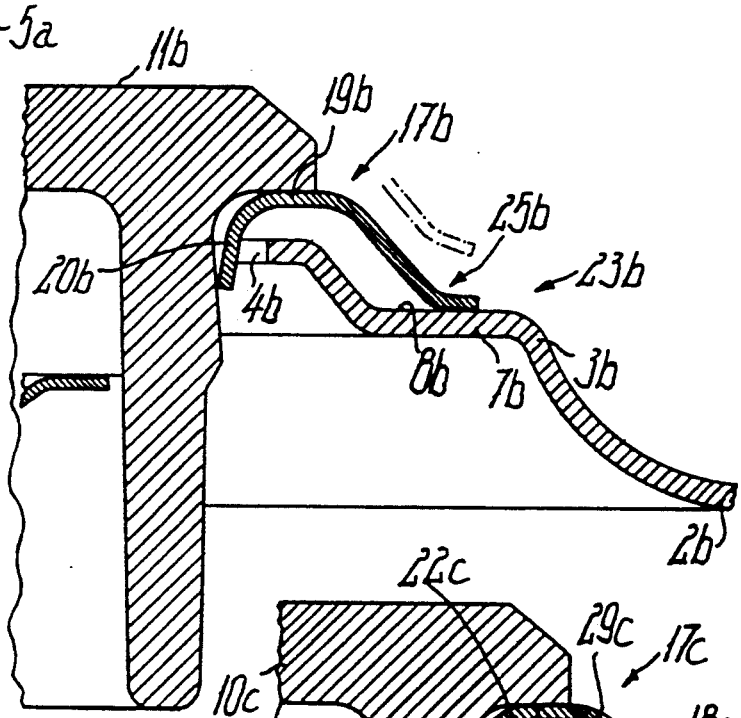
Figure 5:
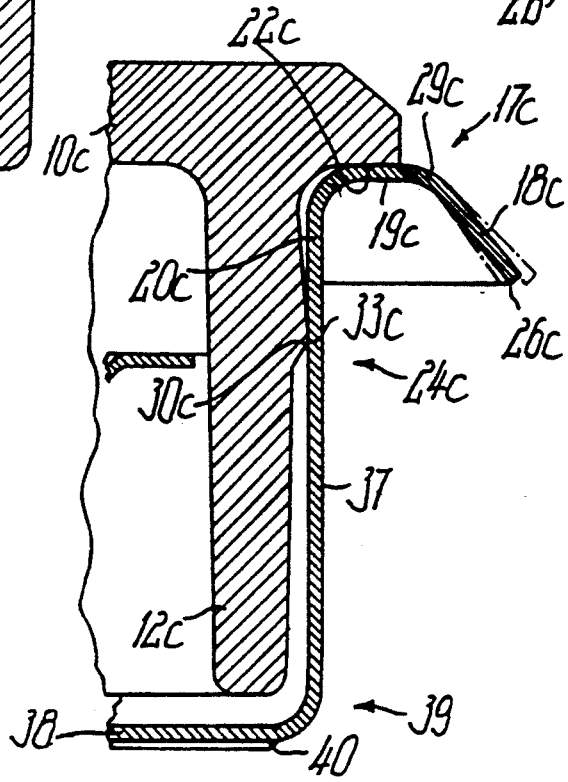

In FIGS. 3 to 5 corresponding parts are given the same reference numerals as in the other drawings, but are followed by different letter references.

In the embodiment according to FIG. 3 the sill **3*a* is much flatter or shallower than in the embodiment according to FIGS. 1 and 2, the seat 8*a* not passing in stepped form into the inner torus, but instead forming a continuous extension of its radially outer flank. Seat 8*a*, which is roughly twice as wide as support surface 26*a* drops in cross-sectionally radially outer manner under a few radians and passes in a shallow S-shaped form via two interconnected, oppositely directed curvature areas into the main plane of the hob 2*a*. Seat part 25*a* or circular rim 28*a* follow the seat part 7*a* in radially outwardly falling manner, so that the cup spring-like circular rim 28*a* is still flat frustum-shaped in the braced position and consequently the interengaging seals rise slightly radially inwards. Rim 3*a* or its torus is located substantially completely below the profile part 20*a* or its apex extends approximately level to the circular edge 30*a*, so that still 3*a* engages at the most slightly into the underside of profile ring 17*a***.

FIG. 4 shows another construction of a hob **2*b* or the sill 3*b*, in which the opening 4*b* for the engagement of the electric hotplate is formed by a break in the hob 2*b*, said break being produced after the shaping out of sill 3*b*. In this case sill 3*b* is formed radially inwards on seat 8*b* or seat part 7*b* following onto a step-like, upwardly rising casing part engaging in profile ring 17*b* and which passes into a substantially planar end wall, which is washer-like because it is traversed by the opening 4*b* which has a slightly smaller width than it. The inner circumference of opening 4*b* surrounds the profile part 20*b* with a small gap spacing and also said end wall is in height spacing below the profile portion 19*b* roughly in center of profile part 20*b*. Profile ring 17*b*** is constructed in substantially the same way as that according to FIGS. 1 and 2. The support surface 8*b* can be substantially plane-parallel to cooking surface 11*b* or can slightly drop away.

In the embodiments according to FIGS. 1 to 4, the radial extension of the profile of profile ring 17 is much larger than its axial extension, namely e.g. roughly twice as large. In the construction according to FIG. 5 the axial extension of profile ring 17*c* is several times this, so that profile ring 17*c* or its inner profile part 20*c* passes into a protective casing 37, which surrounds with a relatively narrow gap clearance the surface-flush part of the hotplate body 10*c* or the outer flange rim 12*c* over at least part of its height. The protective casing 37, which is approximately linear or forms generatrixes roughly parallel to the hotplate axis substantially over its entire height or up to the transition into profile portion 19*c* passes at the lower end into a preferably substantially planar base part 38, constructed integrally therewith and which is located with a limited spacing below the underside of hotplate body 10*c* or the outer flange rim 12*c* and in the central area has a passage opening for the fastening screw, as well as a circular support surface surrounding the same for support purposes with respect to the center stud 14. The common casing part formed by profile part 20*c* and protective casing 37 engages linearly on hotplate body 10*c* only along a single circular zone, which is below the profile leg 18*c* and above the center of the height of flange rim 12*c* and is in particular between the two upper thirds of the height of rim 12*c*. The linear zone can be formed in simple manner by engaging ring edge 33*c* on inner circumference 30*c* of protective casing 37 or profile part 20*c*, said engagement having pressing in such a way that the two components are securely reciprocately positionally secured. Above and below ring edge 33*c* the protective casing 37 is spaced from the outer circumference of the outer flange rim 12*c*. In the embodiment according to FIG. 5, which is suitable for each of the described sill or spillage edge forms, although the support surface can be formed by an angular circular rim, in the represented case it is formed by a sharp, circular edge, namely the radially inner circular edge of the edge face of the profile leg 18*c*, so that in this case the support surface 26*c* is located slightly radially inside the radially outermost boundary of the profile ring 17*c* or profile leg 18*c*. The profile leg 18*c* passes from the resilient cross-sectional zone 29*c* to the support surface 26*c* in cross-sectionally substantially continuously linear manner, so that its terminal edge is directed downwards. The support surface 26*c* simultaneously forms the sliding edge in the case of resilient deflection of the profile leg 18*c*. The protective casing 37 forms a housing 39 integral with the profile ring 17*c* for lining and terminating the hotplate body 10*c* under the bearing surface 22*c*, said housing 39 also being able to completely replace the lower cover for body 10*c* and in the base part 38 can carry the insulator for the passage of the leads.

As is also shown in FIG. 5, particularly if the protective casing 37 or base part 38 is interrupted or perforated for ventilating the underside of the electric hotplate, in order to prevent the penetration of water into the interior of the hotplate, at least one dripping edge 40 can be provided in the flow path of any water which might have penetrated beneath the profile ring 17*c*, in such a way that water flowing down casing 37 necessarily reaches the dripping edge 40 and finds so little adhesion there that it is necessarily torn away and drips downwards. The circular, downwardly directed dripping edge 40 bounded by acute-angled sides can be provided in the casing part, in the base part or in the transition area between them. In the represented embodiment the dripping edge 40 is provided in the transition area between the casing part and the base part 30 or on the radially outermost boundary thereof, where the base part 38 passes to the casing part.

The spillage edge is appropriately formed from casing portions of a pipe, which approximately correspond to the external diameter thereof. The pipe is wound from the sheet metal blank in such a way that the overlapping longitudinal edges of said blank are interconnected by a longitudinal weld. The pipe portion cut from this pipe is so compressed, that profile leg 18, profile portion 19 and profile part 20 are formed. The thus prepressed ring is then automatically removed and placed in a second press mold, in which the circular border 28 is produced in the same cycle as the ring blank previously. Despite a second operation, virtually no extra expenditure is involved. Moreover, in the second working or pressing process, it is possible to calibrate the profile ring 17 and any burrs on the outer edge of the circular border 28 can be removed by pressing. The represented profile form of the ring can also be so advantageously rounded that the seat part 25 with the profile leg 18 and the profile portion 19 forms a S-shaped curve. In order to improve the flexibility and spring action of seat part 25, the ring material in the vicinity of seat part 25 or its transition to the profile leg 18 can undergo a thickness reduction during shaping.

I claim:

1. An electric hotplate comprising:

a hotplate body having an annular underside shoulder;

a profile ring fixed to said hotplate body for supporting the hotplate body on a top surface of a hob, said profile ring having a ring leg cross-sectionally descending and radially extending from a bent portion connected radially to a washer-shaped profile portion having a top side engaging said underside shoulder of said hotplate in approximately whole surface contact, said bent portion being located entirely radially outwardly from said underside shoulder, wherein in a circumferentially pretensioned condition the profile ring forms at least one seat member of at least one elastically resilient and pressure-tight pretensioned seal, a surface of said seat member providing a sealing face for a pretensioned liquid pressure tight seal in direct engagement with said top surface of said hob, said sealing face slidingly engaging a bearing seat of said top surface of said hob, with a spring force provided by said circumferentially pretensioned profile ring, said sealing face sloping radially downwardly away from said hotplate body in an untensioned condition, said bearing seat being substantially planar and and slopingly descending away from said hotplate body, an edge of said sealing face being constructed as a sliding edge, thereby providing means for mounting said hotplate by firstly only engaging said sliding edge on said bearing seat and secondly sliding said sliding edge on said bearing seat under said spring force to a condition in which said sealing face entirely engages said bearing seat.

2. The electric hotplate according to claim 1, wherein a profile section of said profile ring spaced from said ring leg and providing a radially inner, at least partly jacket-like profile part is constructed as a seat part of an inner seal.

3. The electric hotplate according to claim 2, wherein an annular sealing edge forming a seat of said inner seal is formed by an outer circumference of an outer flange rim of said hotplate body, an inner circumference of a jacket of said profile section sealingly engaging said outer circumference along a linear zone.

4. The electric hotplate according to claim 3, wherein said annular edge is formed by an outer circumferential edge of an offset ring shoulder of said hotplate body, said shoulder in cross-section being arranged at an obtuse angle with respect to at least one of two connecting circumferential surfaces of said flange rim, said sealing edge engaging said inner circumference only along a single linear zone.

5. The electric hotplate according to claim 1, wherein an inner profile section substantially connecting to said profile ring and providing a radially inner, jacket-like profile part fixedly connected to said hotplate body, is longer than said ring leg, said profile part providing a protecting jacket for an outer circumference of an outer flange rim of said hotplate body, said protecting jacket extending below an outer shoulder provided on said outer circumference.

6. The electric hotplate according to claim 5, wherein said protecting jacket extends over substantially an entire height extension of said hotplate body.

7. The electric hotplate according to claim 5, wherein said protecting jacket is provided close to an outer flange rim of said hotplate body.

8. The electric hotplate according to claim 5, wherein said protecting jacket is connected in substantially sealed manner to said profile ring.

9. The electric hotplate according to claim 5, wherein said protecting jacket emanates as an integral extension from a radially inner, jacket-like profile part of said profile ring.

10. The electric hotplate according to claim 5, wherein said protecting jacket passes into a partly closed base part located on an underside of said hotplate body.

11. The electric hotplate according to claim 5, wherein said protecting jacket provides at least one dripping edge connected to an outer circumference of said protecting jacket via a flow path ducting liquid to the dripping edge.

12. The electric hotplate according to claim 1, wherein at least one dripping edge spaced from said hotplate body is arranged below said profile ring.

13. The electric hotplate according to claim 12, wherein said dripping edge is spaced from a radially outer flange rim of said hotplate body.

14. The electric hotplate according to claim 1, wherein said bent portion substantially tangentially connects to said profile portion supported against said underside shoulder of said hotplate body, said profile portion being substantially planar between said bent portion and a radially inner arcuate portion, said profile portion providing a cross-web of a U-profile.

15. The electric hotplate according to claim 1, wherein said sealing face is metallic and adapted to sealingly engage a counterface of at least one of metal and enamel on said top surface of said hob.

16. The electric hotplate according to claim 1, wherein at least said sealing face is conically downwardly widened to define a contour between a flat washer-like contour and an obtuse-angled contour, wherein an untensioned condition said sealing face defines a steeper angle than in a tensioned sealing condition.

17. The electric hotplate according to claim 1, wherein a sliding edge is associated with said sealing face of said seal formed by said profile ring is associated a sliding edge, for accomplishing a sliding movement during sealing pressing of the seal against the hob, said sliding edge being substantially formed by an outer, ring-like edge of said sealing face adapted to be slightly less steep in a sealed position than in a relaxed position.

18. The electric hotplate according to claim 1, wherein in the vicinity of a free end, said ring leg passes along said bent section to an approximately washer-like substantially radially outwardly projecting circular rim forming said sealing face, a median radius of curvature of said bent section being smaller than a median radius of curvature of a cross-sectional zone connecting to said ring leg remote from said sealing face to provide a resilient pivot for said ring leg and said sealing face.

19. The electric hotplate according to claim 1, wherein a profile section spaced from said ring leg and substantially providing a radially inner, jacket-like profile part engages into said hotplate body over a length extension shorter than an axial extension of said profile portion.

20. The electric hotplate according to claim 19, wherein said profile section engages only in the vicinity of an annular sharp edge in a pressing manner on said hotplate body.

21. The electric hotplate according to claim 19, wherein said profile section is radially and axially spaced from said hotplate body except in the vicinity of an annular edge having an edge flank provided by an end face.

22. The electric hotplate according to claim wherein an annular edge of said profile section is formed by said profile ring and provides a sharp sealing edge for sealingly engaging said hotplate body.

23. The electric hotplate according to claim 19, wherein an annular edge of said profile section is formed by a terminal end face located at an end of an inner jacket-like profile part narrowed in acute-angled manner to said end.

24. The electric hotplate according to claim 1, wherein said seat member is formed by said ring leg being resiliently pivotally mounted about said bent portion in the manner of a freely projecting spring arm connected in a transition region to said profile portion, said bent portion being arcuate by a median radius of curvature at least a multiple larger than a thickness extension of a sheet material forming said bent portion, said profile portion being substantially planar and tangentially connecting to said bent portion.

25. An electric hotplate comprising:

a hotplate body having an annular underside shoulder;

a profile ring fixed to said hotplate body for supporting the hotplate body on a top surface of a hob, said profile ring having a ring leg cross-sectionally descending and radially extending from a bent portion connected radially to a washer-shaped profile portion having a top side engaging said underside shoulder of said hotplate, in approximately whole surface contact said bent portion being located entirely radially outwardly from said underside shoulder, wherein the profile ring forms at least one seat member of at least one elastically resilient seal, a surface of said seat member providing a sealing face for a liquid tight sealed direct engagement onto said top surface of said hob, said sealing face slidingly engaging a bearing seat of said top surface of said hob, said bearing seat sloping radially downwardly away from said hotplate body.

* * * * *